US011342667B2

(12) United States Patent
Wang

(10) Patent No.: US 11,342,667 B2
(45) Date of Patent: May 24, 2022

(54) ANTENNA STRUCTURE AND MOBILE TERMINAL

(71) Applicant: Beijing Xiaomi Mobile Software Co., Ltd., Beijing (CN)

(72) Inventor: Ching-Sung Wang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/743,622

(22) Filed: Jan. 15, 2020

(65) Prior Publication Data

US 2021/0083381 A1 Mar. 18, 2021

(30) Foreign Application Priority Data

Sep. 18, 2019 (CN) ..... 201910882121.6

(51) Int. Cl.
*H01Q 5/307* (2015.01)
*H01Q 9/04* (2006.01)
*H01Q 1/24* (2006.01)

(52) U.S. Cl.
CPC ..... *H01Q 5/307* (2015.01); *H01Q 1/243* (2013.01)

(58) Field of Classification Search
CPC .. H01Q 1/22; H01Q 1/24; H01Q 5/30; H01Q 9/04; H01Q 9/0407; H01Q 9/0414; H01Q 9/065; H01Q 21/00; H01Q 21/06; H01Q 1/241; H01Q 5/10; H01Q 5/307
See application file for complete search history.

(56) References Cited

U.S. PATENT DOCUMENTS

| | | | | |
|---|---|---|---|---|
| 5,124,733 | A | 6/1992 | Haneishi | |
| 5,497,164 | A * | 3/1996 | Croq | H01Q 9/0414 343/700 MS |
| 6,348,892 | B1 | 2/2002 | Annamaa et al. | |
| 8,525,737 | B2 | 9/2013 | Rho et al. | |
| 9,368,860 | B2 | 6/2016 | Hossain | |
| 2004/0027285 | A1 | 2/2004 | Fang | |
| 2004/0032368 | A1 | 2/2004 | Spittler | |
| 2019/0020110 | A1 * | 1/2019 | Paulotto | H01Q 19/005 |
| 2019/0157762 | A1 | 5/2019 | Shibata et al. | |

(Continued)

FOREIGN PATENT DOCUMENTS

| | | | |
|---|---|---|---|
| CN | 101051707 | A | 10/2007 |
| CN | 201278368 | Y | 7/2009 |

(Continued)

OTHER PUBLICATIONS

International Search Report in Application No. PCT/CN2019/120791, dated Jun. 22, 2020.

(Continued)

*Primary Examiner* — Blane J Jackson
(74) *Attorney, Agent, or Firm* — Finnegan, Henderson, Farabow, Garrett & Dunner, L.L.P.

(57) ABSTRACT

The present disclosure relates to an antenna structure and a mobile terminal. The antenna structure includes: a first antenna and a second antenna; wherein the first antenna is configured to radiate signals of a first frequency band; the second antenna is configured to radiate signals of a second frequency band, and the second frequency band is higher than the first frequency band; and the second antenna is stacked and disposed above the first antenna.

16 Claims, 3 Drawing Sheets

(56) References Cited

U.S. PATENT DOCUMENTS

| | | | | |
|---|---|---|---|---|
| 2019/0165476 | A1* | 5/2019 | Hong | H01Q 19/005 |
| 2019/0267697 | A1 | 8/2019 | Quinlan et al. | |
| 2020/0127387 | A1* | 4/2020 | Park | H01Q 21/08 |
| 2021/0036427 | A1* | 2/2021 | Hautcoeur | H01Q 1/521 |

FOREIGN PATENT DOCUMENTS

| | | | |
|---|---|---|---|
| CN | 103311670 | A | 9/2013 |
| CN | 204179230 | U | 2/2015 |
| CN | 104798257 | A | 7/2015 |
| CN | 204991952 | U | 1/2016 |
| CN | 105932419 | A | 9/2016 |
| CN | 108461924 | A | 8/2018 |
| EP | 3 065 219 | A1 | 9/2016 |
| EP | 3 474 379 | A1 | 4/2019 |
| JP | H 3-263903 | A | 11/1991 |
| JP | H 8-23222 | A | 1/1996 |
| JP | 2001-512640 | A | 8/2001 |
| JP | 2003-283240 | A | 10/2003 |
| JP | 2005-210517 | A | 8/2005 |
| JP | 2007-282174 | A | 10/2007 |
| JP | 2010-226633 | A | 10/2010 |
| JP | 2012-529827 | A | 11/2012 |
| JP | 2013-090183 | A | 5/2013 |
| JP | 2014-135703 | A | 7/2014 |
| KR | 20080016353 | A | 2/2008 |
| KR | 20100097318 | A | 9/2010 |
| KR | 20110025547 | A | 3/2011 |
| KR | 20190044023 | A | 4/2019 |

OTHER PUBLICATIONS

Extended European Search Report in European Application No. 20159268.0, dated Oct. 5, 2020.

Notification of Reason for Refusal dated May 17, 2021, from Korean Patent Office, in counterpart Korean Application No. 10-2020-7001697.

English version of International Search Report from the China National Intellectual Property Administration in corresponding International Application No. PCT/CN2019/120791, dated Jun. 22, 2020.

First Office Action dated Jun. 23, 2021, from the State Intellectual Property Office of People's Republic of China issued in counterpart Chinese Application No. 201910882121.6.

Second Office Action dated Jan. 6, 2022, from the State Intellectual Property Office of People's Republic of China issued in counterpart Chinese Application No. 201910882121.6.

Notice of Reasons for Refusal dated Jan. 4, 2022, from the Japanese Patent Office issued in counterpart Japanese Application No. 2020-502276.

* cited by examiner

ANTENNA STRUCTURE AND MOBILE TERMINAL

CROSS-REFERENCE TO RELATED APPLICATIONS

The present application is based upon and claims priority to Chinese Patent Application No. 201910882121.6, filed on Sep. 18, 2019, the content of which is hereby incorporated by reference in its entirety.

TECHNICAL FIELD

The present disclosure relates to the field of antenna technologies, and in particular, to an antenna structure and a mobile terminal.

BACKGROUND

With the development of communication technology, the era of 5G (fifth generation mobile communication technology) communication is coming.

In order to meet the requirements of 5G communication and compatible with frequency bands such as 4G/3G/2G, the number of antennas in a mobile terminal may need to be increased. However, user requirement for a thinner and lighter mobile terminal results in limited internal space of the mobile terminal.

SUMMARY

According to a first aspect of an embodiment of the present disclosure, an antenna structure is provided, the antenna structure including: a first antenna and a second antenna; wherein the first antenna is configured to radiate signals of a first frequency band; the second antenna is configured to radiate signals of a second frequency band, and the second frequency band is higher than the first frequency band; and the second antenna is stacked and disposed above the first antenna.

According to a second aspect of an embodiment of the present disclosure, there is provided a mobile terminal comprising the antenna structure according to the first aspect.

The above general description and the following detailed description are intended to be illustrative and not restrictive.

BRIEF DESCRIPTION OF THE DRAWINGS

The accompanying drawings herein, which are incorporated into the specification, constitute part of the specification, and show the embodiments of the present disclosure, and are used together with the specification to explain the principles of the specification.

DETAILED DESCRIPTION

Exemplary embodiments will be described in detail herein, examples of which are illustrated in the accompanying drawings. The same label in the following description refers to the same or similar elements in the different figures unless otherwise indicated. The embodiments described below are exemplary embodiments and do not represent all embodiments consistent with the present disclosure. Instead, they are merely examples of devices and methods consistent with aspects of the present disclosure as recited in the appended claims.

Figure 1:
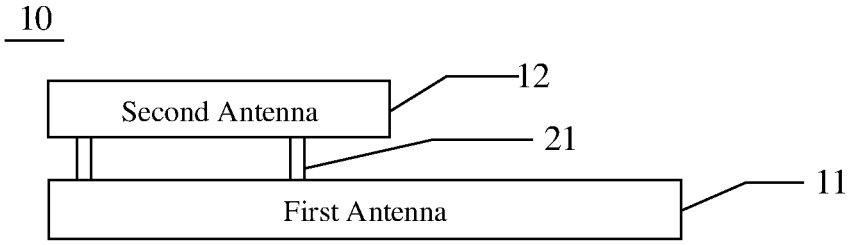
FIG. 1 is a schematic diagram of an antenna structure according to an exemplary embodiment of the present disclosure.

FIG. 1 is a schematic diagram of an antenna structure 10 according to an exemplary embodiment of the present disclosure. As shown in FIG. 1, the antenna structure 10 may include a first antenna 11 and a second antenna 12.

The first antenna 11 is configured to radiate signals of a first frequency band, and the second antenna 12 is configured to radiate signals of a second frequency band. In the embodiment, the first frequency band and the second frequency band are two different frequency bands, wherein the frequency of the second frequency band is higher than the frequency of the first frequency band. For example, the frequency range of the first frequency band is [a, b], the frequency range of the second frequency band is [c, d], and the frequency of the second frequency band is higher than the frequency of the first frequency band, that is, c is greater than b, the above a, b, c, and d are frequency values, and the unit can be Hertz (Hz).

In one embodiment, the first frequency band is a non-5G frequency band, and the non-5G frequency band is the frequency range of radio waves of 2G (second generation mobile communication technology), 3G (third generation mobile communication technology), and 4G (fourth generation mobile communication technology). Wherein, the frequency range of the 4G frequency band includes the following three types of 1880~1900 MHz, 2320~2370 MHz and 2575~2635 MHz, and the frequencies of the 2G frequency band and the 3G frequency band are lower than those of the 4G frequency band.

In one embodiment, the second frequency band is a sub-6G frequency band (a frequency band below 6 GHz, also referred to as an FR1 frequency band) in the 5G frequency band, wherein the 5G frequency band is a frequency range of the 5G radio wave, and the frequency range of the sub-6G frequency band is 450 MHz~6000 MHz. Compared with the above non-5G frequency bands, the 5G frequency band covers a wider frequency range, that is, the 5G frequency band is higher than the non-5G frequency band. The sub-6 GHz frequency band is a frequency range in which a sub-6G antenna receives or transmits radio waves. In some embodiments, the second frequency band may also be a millimeter wave frequency band in the 5G frequency band, the millimeter wave frequency band being a frequency range of the millimeter wave, the frequency range of the millimeter wave frequency band being 24.25 GHz~52.6 GHz, and the millimeter wave frequency band being also called FR2 band.

The second antenna 12 is stacked and disposed above the first antenna 11. In one embodiment, both of the first antenna 11 and the second antenna 12 have a flat plate shape and a thickness of 0.3 to 0.6 mm. It should be noted that the thicknesses of the first antenna 11 and the second antenna 12 may be the same or different, which is not limited in the embodiments of the present disclosure.

In one embodiment, the area of the second antenna 12 is smaller than the area of the first antenna 11, that is, when the second antenna 12 is stacked and disposed above the first antenna 11, the second antenna 12 does not completely block the first antenna 11, so that the normal reception or transmission of the signal of the first antenna 11 is guaranteed.

In one embodiment, the projection of the second antenna 12 on the plane where the first antenna 11 is located, is located in an edge region of the first antenna 11. Wherein, the edge region is an area in the first antenna 11 where the distance from the antenna boundary is less than a certain threshold. In one embodiment, the threshold is determined according to the plane size of the first antenna 11. For example, when the plane size of the first antenna 11 is 50*10 mm, an area that is less than 2 mm from the boundary of the first antenna 11 is an edge area; also for example, when the plane size of the first antenna 11 is 100*20 mm, an area less than 4 mm from the boundary of the first antenna 11 is an edge region. In one embodiment, the second antenna 12 is disposed at a corner position or an edge position of the first antenna 11, which is not limited in the present disclosure. For example, when the first antenna 11 is rectangular or approximately rectangular, the projection area of the second antenna 12 on the plane where the first antenna 11 is located may be located in the vicinity of any corner of the first antenna 11 or in the vicinity of any side of the first antenna 11.

In one embodiment, as shown in FIG. 1, a first support structure 21 is provided between the second antenna 12 and the first antenna 11. The first support structure 21 is configured to make a certain gap between the second antenna 12 and the first antenna 11 to avoid interference between the signals of the two antennas, thereby ensuring the normal reception or transmission of the signals. The first support structure 21 has a non-conductive property. In one embodiment, the material of the first support structure 21 may be rubber, glass, diamond, or a non-conductive metal, and the like, which is not limited in the present disclosure. Taking non-conductive metal as an example, a polymer insulating coating can be obtained on the metal surface by using the methods such as ordinary coating, electrophoretic coating, electrostatic spraying, fluidized bed coating, and flame spraying; and an inorganic non-metallic insulating layer can be obtained on the metal surface by using the methods such as oxidation, passivation, and phosphating.

In addition, the shape of the first support structure 21 may be a cylindrical shape or a rectangular parallelepiped shape, and the like, which is not limited in the present disclosure. In addition, the number or size of the first support structure 21 is related to the size and shape of the first antenna 11 and the second antenna 12, which can be designed in combination with actual conditions. This is not limited in the present disclosure.

In the above embodiments, by stacking and disposing the second antenna above the first antenna, the space utilization efficiency of the antenna is improved, the cost of the antenna is reduced, the antenna is highly integrated, and the antenna layout is more flexible. In addition, the utilization space of other hardware of the mobile terminal is increased, which is convenient for performance optimization of the entire mobile terminal system.

Figure 2:
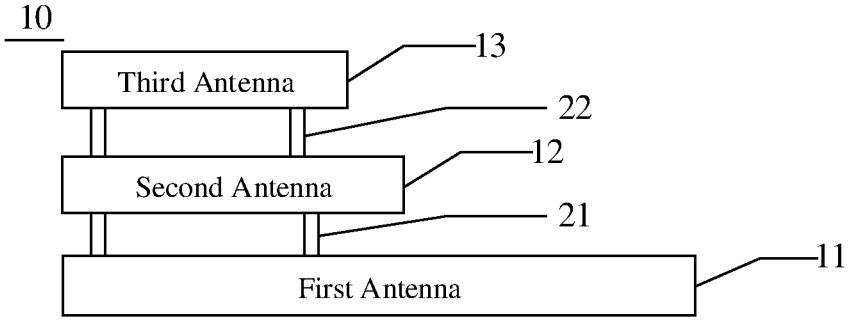
FIG. 2 is a schematic diagram of an antenna structure according to another exemplary embodiment of the present disclosure.

FIG. 2 is a schematic diagram of the antenna structure 10 according to another exemplary embodiment of the present disclosure. As shown in FIG. 2, the antenna structure 10 includes a first antenna 11, a second antenna 12, and a third antenna 13.

The first antenna 11 is configured to radiate signals of a first frequency band. The second antenna 12 is configured to radiate signals of a second frequency band. The third antenna 13 is configured to radiate signals of a third frequency band. The frequency of the second frequency band is higher than the frequency of the first frequency band, and the frequency of the third frequency band is higher than the frequency of the second frequency band. For example, the frequency range of the first frequency band is [a, b], the frequency range of the second frequency band is [c, d], and the frequency range of the third frequency band is [e, f]. The frequency of the second frequency band is higher than the frequency of the first frequency band, which indicates that c is greater than b; the frequency of the third frequency band is higher than the frequency of the second frequency band, which indicates that e is greater than d. The above a, b, c, d, e, f are all frequency values, and the unit may be Hertz (Hz).

In one embodiment, the first frequency band is a non-5G frequency band, such as 2G, 3G, and 4G frequency bands, the second frequency band is a sub-6G frequency band in the 5G frequency band, and the third frequency band is a millimeter wave frequency band in the 5G frequency band. The millimeter wave frequency band is the frequency range of the millimeter wave, which is a radio wave with a wavelength of 1 to 10 mm. For the description about the non-5G frequency band, the sub-6G frequency band, and the millimeter wave frequency band, reference may be made to the foregoing embodiments.

The second antenna 12 is stacked and disposed above the first antenna 11, and the third antenna 13 is stacked and disposed above the second antenna 12. In one embodiment, the third antenna 13 has a flat plate shape and a thickness of 0.3 to 0.6 mm. It should be noted that the thicknesses of the first antenna 11, the second antenna 12, and the third antenna 13 may be the same or different, which is not limited in the present disclosure. In addition, the positions where the second antenna 12 and the third antenna 13 are stacked may be the same or different. For example, the second antenna 12 is stacked and disposed above the upper left corner of the first antenna 11 and the third antenna 13 is stacked and disposed above the upper right corner of the second antenna 12. Also for example, the second antenna 12 is stacked and disposed above the upper left corner of the first antenna 11, and similarly, the third antenna 13 is stacked and disposed above the upper left corner of the second antenna 12, which is not limited in the present disclosure.

In one embodiment, the area of the third antenna 13 is smaller than that of the second antenna 12, that is, when the third antenna 13 is stacked and disposed above the second antenna 12, the third antenna 13 does not completely cover the second antenna 12, so that the normal reception or transmission of the signal of the second antenna 12 is guaranteed.

In one embodiment, the projection of the third antenna 13 on the plane where the second antenna 12 is located is located at an edge region of the second antenna 12. Similar to the edge area of the first antenna 11 described above, the edge area of the second antenna 12 is an area in the second antenna 12 where the distance from the antenna boundary is less than a certain threshold. In one embodiment, the threshold is determined according to the plane size of the second antenna 12. In one embodiment, the third antenna 13 is disposed at a corner position or an edge position of the second antenna 12, which is not limited in the present disclosure. For example, when the second antenna 12 is rectangular or approximately rectangular, the projection area of the third antenna 13 on the plane where the second antenna 12 is located may be located in the vicinity of any corner of the second antenna 12 or in the vicinity of any side of the second antenna 12.

In one embodiment, as shown in FIG. 2, a second support structure 22 is provided between the third antenna 13 and the second antenna 12. Similar to the first support structure 21, the second support structure 22 is configured to make a certain gap between the third antenna 13 and the second antenna 12 to avoid interference between the signals of the two antennas, thereby ensuring the normal reception or transmission of signals. The second supporting structure 21 has a non-conductive property. In one embodiment, the material of the second supporting structure 22 may be rubber, glass, diamond, or non-conductive metal, and the like, which is not limited in the embodiment of the present disclosure.

In addition, the shape of the second supporting structure 22 may be a cylindrical shape or a rectangular parallelepiped shape, and the like, which is not limited in the present disclosure. In addition, in the embodiment, the number or the size of the second supporting structures 22 is related to the size and the shape of the second antenna 12 and the third antenna 13.

It should be noted that the manufacturing materials, shapes, or sizes of the second support structure 22 and the first support structure 21 may be the same or different, which may be designed in combination with actual conditions, which is not limited in the present disclosure.

Figure 3:
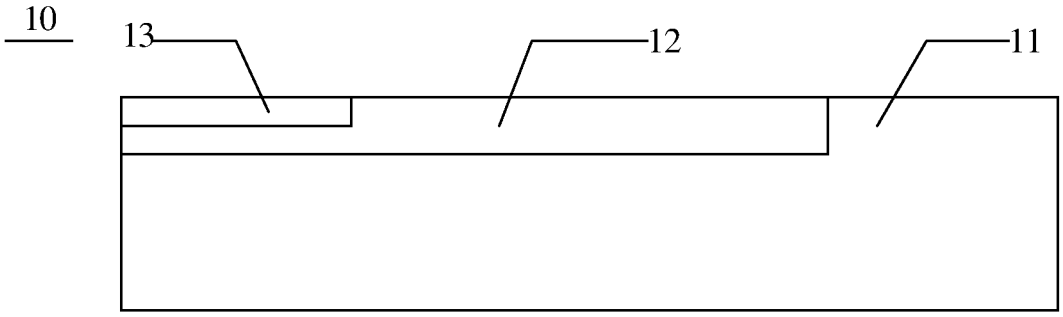
FIG. 3 exemplarily shows a schematic plan view of an antenna structure when a second antenna and a third antenna are at different levels, according to an exemplary embodiment of the present disclosure.

For the above stacking method, the second antenna 12 and the third antenna 13 are at different levels. With reference to FIG. 3, taking the same stacking position of the second antenna 12 and the third antenna 13 as an example, in the antenna structure 10, the first antenna 11 is placed at the lowest level, the second antenna 12 is stacked and disposed above the upper left corner of the first antenna 11 through the first support structure 21 (not shown in FIG. 3), and the third antenna 13 is stacked and disposed above the upper left corner of the second antenna 12 through the second support structure 22 (shown in FIG. 3).

In the above embodiments, by stacking and disposing the third antenna on the edge area of the second antenna, the signal receiving or transmitting range of the antenna is expanded, the cost of the antenna is reduced, and the antenna is highly integrated.

Figure 4:
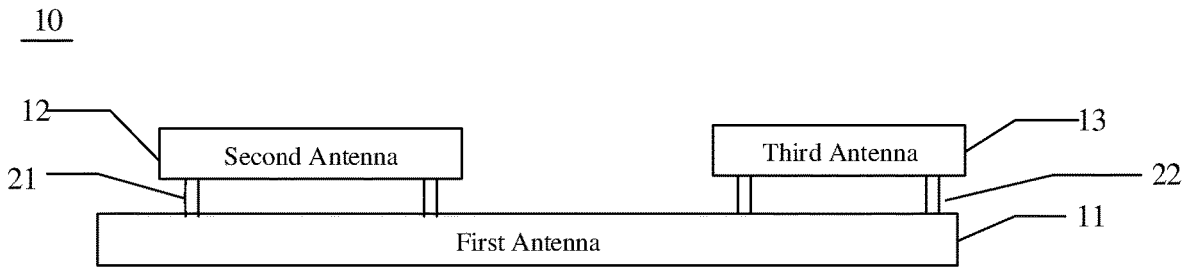
FIG. 4 is a schematic diagram of an antenna structure according to still another exemplary embodiment of the present disclosure.

FIG. 4 is a schematic diagram of the antenna structure 10 according to another exemplary embodiment of the present disclosure. As shown in FIG. 4, the antenna structure 10 includes a first antenna 11, a second antenna 12, and a third antenna 13.

The first antenna 11 is configured to radiate signals of a first frequency band. The second antenna 12 is configured to radiate signals of a second frequency band. The third antenna 13 is configured to radiate signals of a third frequency band. The frequency of the second frequency band is higher than the frequency of the first frequency band, and the frequency of the third frequency band is higher than the frequency of the first frequency band. For example, the frequency range of the first frequency band is [a, b], the frequency range of the second frequency band is [c, d], and the frequency range of the third frequency band is [e, f]. The frequency of the second frequency band higher than the frequency of the first frequency band indicates that c is greater than b; the frequency of the third frequency band higher than the frequency of the first frequency band indicates that e is greater than b. The above a, b, c, d, e, f are all frequency values, and the unit may be Hertz (Hz).

In one embodiment, the first frequency band is a non-5G frequency band, such as 2G, 3G, and 4G frequency bands, the second frequency band is a sub-6G frequency band in a 5G frequency band, and the third frequency band is a millimeter wave frequency band in a 5G frequency band. In another embodiment, the first frequency band is a non-5G frequency band, such as 2G, 3G, and 4G frequency bands, the second frequency band is a millimeter wave frequency band in the 5G frequency band, and the third frequency band is a sub-6G frequency band in the 5G frequency band.

In the embodiment, the second antenna 12 is stacked and disposed above the first antenna 11, the third antenna 13 is stacked and disposed above the first antenna 11, and the third antenna 13 and the second antenna 12 are located on different positions above the first antenna 11. For example, the second antenna 12 is stacked and disposed above the upper left corner of the first antenna 11, and the third antenna 13 is stacked and disposed above the upper right corner of the first antenna 11.

It should be noted that the area, layered area, and supporting structure of the first antenna 11, the second antenna 12, or the third antenna 13 have been described in detail above, and are not repeated here.

Figure 5:
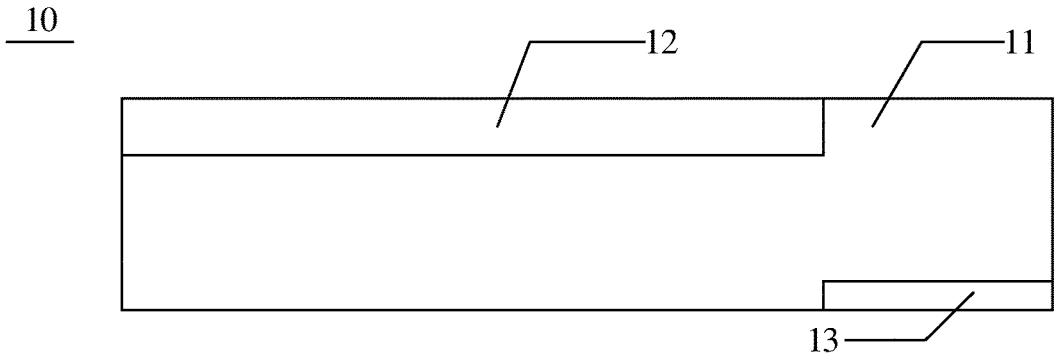
FIG. 5 exemplarily shows a schematic plan view of an antenna structure when a second antenna and a third antenna are at same level, according to an exemplary embodiment of the present disclosure.

For the above stacking method, the second antenna 12 and the third antenna 13 are at the same level. With reference to FIG. 5, taking the different stacking position of the second antenna 12 and the third antenna 13 as an example, in the antenna structure 10, the first antenna 11 is placed at the lowest level, the second antenna 12 is stacked and disposed above the upper left corner of the first antenna 11 through a first support structure 21 (not shown in FIG. 5), and the third antenna 13 is stacked and disposed above the lower right corner of the first antenna 12 through the second support structure 22 (not shown in FIG. 3).

In the embodiment, the third antenna is stacked and disposed on the edge area of the first antenna, so that the second antenna and the third antenna are at the same level, thereby expanding the signal receiving or transmitting range, improving the space utilization of the antenna, reducing the cost of the antenna, and realizing high integration of the antenna.

In the above embodiments, the antenna structure including two antennas or three antennas is taken as an example for illustration. In some other embodiments, the antenna structure may also include four or more antennas, and each antenna can be stacked according to any of the stacking methods described above. The frequency range of the antenna located above is greater than the frequency range of the antenna located below, and one antenna can be stacked and disposed above one antenna (as shown in the embodiment of FIG. 2), and multiple antennas (as shown in the embodiment of FIG. 3) may also be stacked.

Figure 6:
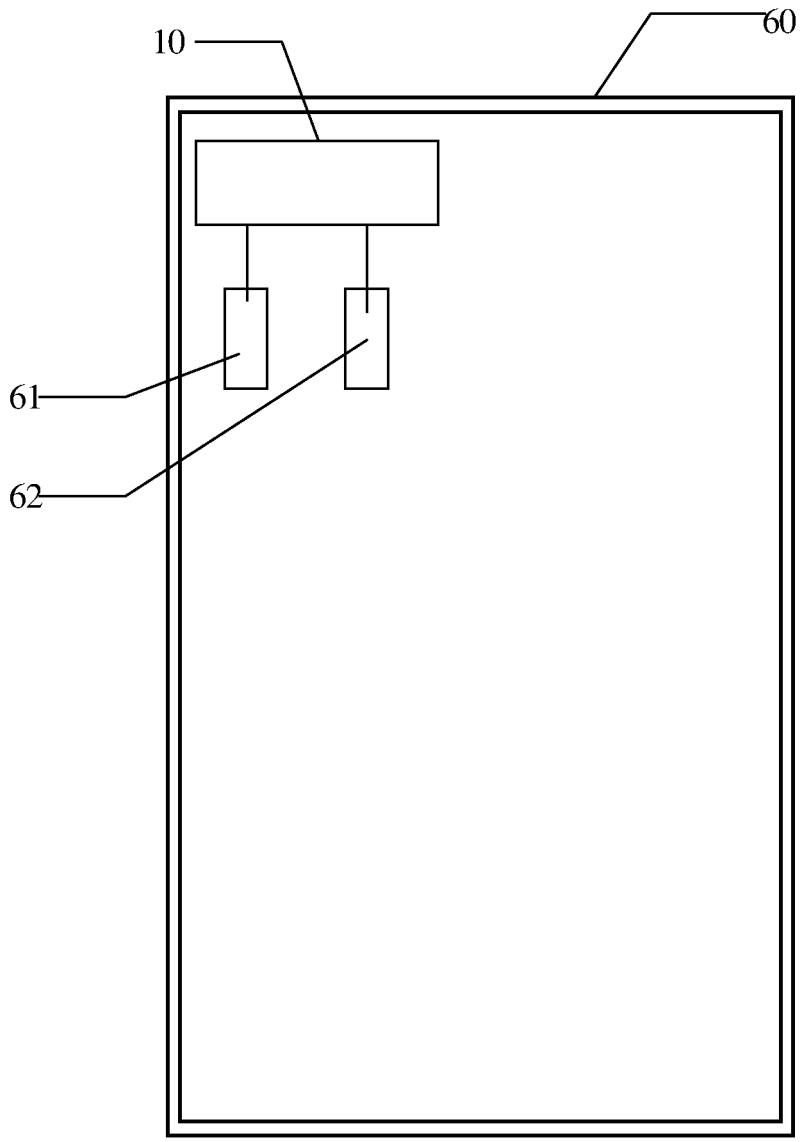
FIG. 6 is a schematic diagram of a mobile terminal according to an exemplary embodiment of the present disclosure.

FIG. 6 is a schematic diagram of a mobile terminal 60 according to an exemplary embodiment of the present disclosure. The mobile terminal 60 includes the antenna structure 10 described above.

In one embodiment, as shown in FIG. 6, the antenna structure 10 is located at the upper left corner of the mobile terminal 60. The antenna structure 10 is connected to a power feeding circuit 61 and a ground circuit 62. The feeding circuit 61 is configured to provide power to the antenna structure 10 to ensure the normal operation of the antenna structure 10. The ground circuit 62 is configured to protect the antenna structure 10 from being damaged by an excessive current when the power feeding circuit 61 fails.

In one embodiment, at least two of the first antenna 11, the second antenna 12, and the third antenna 13 are connected to different feeding circuits 61, and at least two of the first antenna 11, the second antenna 12, and the third antenna 13 are connected to different ground circuits 62. For example, the first antenna 11 is connected to a feeding circuit A and a ground circuit A; the second antenna 12 is connected to a feeding circuit B and a ground circuit B; and the third antenna 13 is connected to a feeding circuit C and a ground circuit C. In another embodiment, the first antenna 11, the second antenna 12, and the third antenna 21 are connected to the same feeding circuit 61 or ground circuit 62, for example, the first antenna 11, the second antenna 12, and the third antenna 13 are connected to the same feeding circuit, and the first antenna 11, the second antenna 12, and the third antenna 13 are connected to the same ground circuit.

In one embodiment, the placement positions of the antenna structure 10 in different mobile terminals are different. For example, the antenna structure 10 may be placed in the upper left corner, the upper right corner, the lower left corner, or the lower right corner of the mobile terminal 60, and the like, which is not limited in the present disclosure.

In one embodiment, the mobile terminal 60 further includes: a screen display, a power supply battery, a camera, a distance sensor, a pressure sensor, a central processing unit (CPU), and the like, which are not limited in the present disclosure.

In the embodiments of the present disclosure, by stacking and disposing the second antenna above the first antenna, the space utilization efficiency of the antenna is improved, the cost of the antenna is reduced, the antenna is highly integrated, and the antenna layout is more flexible. In addition, the utilization space of other hardware of the mobile terminal is increased, which is convenient for performance optimization of the entire mobile terminal system.

The following technical effects may be achieved in the technical solutions provided by the embodiments of the present disclosure.

By arranging the second antenna on the first antenna, the space utilization of the antenna is improved, the cost of the antenna is reduced, the antenna is highly integrated, and the antenna layout is more flexible. In addition, the utilization space of other hardware of the mobile terminal is increased, which is convenient for performance optimization of the entire mobile terminal system.

Other embodiments of the present disclosure will be apparent to one of ordinary skill in the art after considering the specification and practicing the embodiments disclosed herein. This application is intended to cover any variations, uses, or adaptations of this disclosure that conform to the general principles of this disclosure and include the common general knowledge or conventional technical means in the technical field not disclosed in this disclosure. It is intended that the specification and examples be considered as exemplary only, with a true scope and spirit of the disclosure being indicated by the following claims.

It should be understood that the present disclosure is not limited to the precise structure that has been described above and illustrated in the drawings, and various modifications and changes can be made without departing from the scope thereof. The scope of the disclosure is limited only by the following claims.

What is claimed is:

1. An antenna structure, comprising:

a first antenna and a second antenna;

wherein the first antenna is configured to radiate signals of a first frequency band;

the second antenna is configured to radiate signals of a second frequency band, the second frequency band being higher than the first frequency band; and the second antenna is stacked and disposed above an upper corner of the first antenna through a first support structure.

2. The antenna structure according to claim 1, wherein an area of the second antenna is smaller than an area of the first antenna.

3. The antenna structure according to claim 1, wherein the first support structure is disposed between the second antenna and the first antenna.

4. The antenna structure according to claim 1, further comprising a third antenna;

wherein the third antenna is configured to radiate signals of a third frequency band, and the third frequency band is higher than the second frequency band; and the third antenna is stacked and disposed above the second antenna.

5. The antenna structure according to claim 4, wherein an area of the third antenna is smaller than the area of the second antenna.

6. The antenna structure according to claim 4, wherein a projection of the third antenna on a plane where the second antenna is located is located in an edge region of the second antenna.

7. The antenna structure according to claim 4, wherein a second support structure is disposed between the third antenna and the second antenna.

8. The antenna structure according to claim 1, further comprising a third antenna;

wherein the third antenna is configured to radiate signals of a third frequency band, and the third frequency band is higher than the first frequency band; and the third antenna is stacked and disposed above the first antenna, and the third antenna and the second antenna are disposed at different positions above the first antenna.

9. A mobile terminal, comprising an antenna structure, wherein the antenna structure comprises:

a first antenna and a second antenna;

wherein the first antenna is configured to radiate signals of a first frequency band;

the second antenna is configured to radiate signals of a second frequency band, the second frequency band being higher than the first frequency band; and the second antenna is stacked and disposed above an upper corner of the first antenna through a first support structure.

10. The mobile terminal according to claim 9, wherein an area of the second antenna is smaller than an area of the first antenna.

11. The mobile terminal according to claim 9, wherein the first support structure is disposed between the second antenna and the first antenna.

12. The mobile terminal according to claim 9, wherein the antenna structure further comprises a third antenna;

the third antenna is configured to radiate signals of a third frequency band, and the third frequency band is higher than the second frequency band; and the third antenna is stacked and disposed above the second antenna.

13. The mobile terminal according to claim 12, wherein an area of the third antenna is smaller than the area of the second antenna.

14. The mobile terminal according to claim 12, wherein a projection of the third antenna on a plane where the second antenna is located is located in an edge region of the second antenna.

15. The mobile terminal according to claim 12, wherein a second support structure is disposed between the third antenna and the second antenna.

16. The mobile terminal according to claim 9, wherein the antenna structure further comprises a third antenna;

the third antenna is configured to radiate signals of a third frequency band, and the third frequency band is higher than the first frequency band; and the third antenna is stacked and disposed above the first antenna, and the third antenna and the second antenna are disposed at different positions above the first antenna.

* * * * *